US005939018A

United States Patent [19]

Ohtsubo et al.

[11] Patent Number: 5,939,018

[45] Date of Patent: Aug. 17, 1999

[54] MARTENSITIC STAINLESS STEELS FOR SEAMLESS STEEL PIPE

[75] Inventors: Hiroshi Ohtsubo; Tatsuo Kawasaki, both of Chiba; Isao Takada, Aichi, all of Japan

[73] Assignee: Kawasaki Steel Corporation, Japan

[21] Appl. No.: 08/757,681

[22] Filed: Nov. 29, 1996

Related U.S. Application Data

[63] Continuation of application No. 08/622,066, Mar. 26, 1996, abandoned, which is a continuation of application No. 08/457,792, Jun. 1, 1995, abandoned, which is a continuation of application No. 08/318,558, Oct. 5, 1994, abandoned, which is a continuation of application No. 08/151,767, Nov. 15, 1993, abandoned, which is a continuation of application No. 08/007,352, Jan. 21, 1993, abandoned, which is a continuation of application No. 07/793,238, Nov. 12, 1991, abandoned, which is a continuation of application No. 07/635,398, Dec. 26, 1990, abandoned, which is a continuation of application No. 07/428,449, Oct. 30, 1989, abandoned, which is a continuation of application No. 07/298,859, Jan. 19, 1989, abandoned, which is a continuation of application No. 06/902,041, Aug. 26, 1986, abandoned, which is a continuation of application No. 06/660,427, Oct. 10, 1984, abandoned.

[51] Int. Cl.[6] ..... C22C 38/18

[52] U.S. Cl. ..... 420/34; 420/40; 420/41; 420/64

[58] Field of Search ..... 148/325, 327; 420/34, 40, 41, 64

[56] References Cited

U.S. PATENT DOCUMENTS

| | | | |
|---|---|---|---|
| 4,256,486 | 3/1981 | Yoshioka et al. | 420/60 |
| 4,326,885 | 4/1982 | Larson et al. | 420/60 |
| 4,420,335 | 12/1983 | Takagi et al. | 75/124 |
| 4,461,657 | 7/1984 | Rana et al. | 420/64 |
| 5,858,128 | 1/1999 | Miyata et al. | 420/60 |

FOREIGN PATENT DOCUMENTS

| | | | |
|---|---|---|---|
| 55-128566 | 10/1980 | Japan | 420/34 |
| 57-13152 | 1/1982 | Japan . | |
| 57-131351 | 8/1982 | Japan | 75/124 |
| 0954489 | 8/1982 | U.S.S.R. | 75/124 |

*Primary Examiner*—Deborah Yee
*Attorney, Agent, or Firm*—Wenderoth, Lind & Ponack, L.L.P.

[57] ABSTRACT

Martensitic stainless steels that enable the fabrication of high-strength seamless steel pipe suited for use in oil-well pipe and pipeline tubing by means of a Mannesmann plug mill or Mannesmann mandrel mill process, without the formation of defects during production. The heat workability of these steels, which contain no more than 0.30% by weight of carbon and from 11 to 14% by weight of chromium, and have a ferrite content of at least 40% at 1200° C., has been vastly improved by holding the phosphorus and sulfur levels therein to no more than 0.020% and 0.003% by weight, respectively.

4 Claims, No Drawings

MARTENSITIC STAINLESS STEELS FOR SEAMLESS STEEL PIPE

This application is a continuation of now abandoned application, Ser. No. 08/622,066, filed Mar. 26, 1996; which is a continuation of now abandoned application, Ser. No. 08/457,792, filed Jun. 1, 1995; which is a continuation of now abandoned application, Ser. No. 08/318,558, filed Oct. 5, 1994; which is a continuation of now abandoned application Ser. No. 08/151,767, filed Nov. 15, 1993; which is a continuation of now abandoned application Ser. No. 08/007,352, filed Jan. 21, 1993; which is a continuation of now abandoned application Ser. No. 07/793,238, filed Nov. 12, 1991; which is a continuation of now abandoned application Ser. No. 07/635,398, filed Dec. 26, 1990; which is a continuation of now abandoned application Ser. No. 07/428,449, filed Oct. 30, 1989; which is a continuation of now abandoned application Ser. No. 07/298,859 filed Jan. 19, 1989; which is a continuation of now abandoned application Ser. No. 06/902,041, filed Aug. 26, 1986; which is a continuation of now abandoned application Ser. No. 06/660,427, filed Oct. 10, 1984.

BACKGROUND OF THE INVENTION

This invention relates to martensitic stainless steels used in seamless steel pipe such as oil-well pipe and pipeline tubing. Martensitic stainless steels, two representative grades of which are SUS 410 and SUS 420 (Japan Industrial Standard [JIS] designations), have excellent corrosion resistance in highly corrosive environments containing $CO_2$. These materials are thus regarded as excellent candidates for use in oil-well pipe, geothermal well pipe, and pipeline tubing.

The strength of oil-well pipe is normally required to be least equivalent to that of American Petroleum Institute (API) standard L80 grade steel (yield strength≧80 ksi). Pipeline tubing should Generally have a strenoth at least equal to that of API standard X60 grade steel (yield strength≧60 ksi).

Martensitic stainless steels having a variety of strengths can be obtained by the application of specific types of heat treatment, such as quench-tempering, normalizing-tempering, or just tempering. However, it is known that the resistance to stress-corrosion cracking of martensitic stainless steels in $CO_2$-containing environments falls when tempering is performed at a temperature of less than 600° C. We tempered the martensitic stainless steels in Table 1 at various temperatures and cut out test pieces 120 mm long by 20 mm wide by 3 mm thick. These pieces were subjected to U-bend tests at a bending radius of 15 mm in a 3.5% aqueous solution of NaCl heated to 80° C. and having a carbon dioxide partial pressure of 1 atmosphere. As shown in Table 1, each of these steels developed stress-corrosion cracking when tempered at less than 600° C., but none demonstrated stress-corrosion cracking when tempered at 600° C. or more (a cross "X" in Table 2 indicates the presence of stress-corrosion cracking; an open circle "○" indicates the absence of stress-corrosion cracking). Hence, to achieve good resistance to stress-corrosion cracking in $CO_2$-containing environments, an important property of martensitic stainless steels, it is clear that the steel must be tempered at a temperature of at least 600° C.

TABLE 1

| | Tempering temperature (° C.) | | | | | | |
|---|---|---|---|---|---|---|---|
| Type of steel | 450 | 500 | 550 | 600 | 650 | 700 | 750 |
| 0.25C. - 13Cr | X | X | X | ○ | ○ | ○ | ○ |
| 0.2C. - 13Cr | X | X | X | ○ | ○ | ○ | ○ |
| 0.15C. - 13Cr | X | X | X | ○ | ○ | ○ | ○ |
| 0.10C. - 13Cr | X | X | X | ○ | ○ | ○ | ○ |
| 0.03C. - 13Cr - 3Ni - 0.5Mo | X | X | X | ○ | ○ | ○ | |
| 0.03C. - 13Cr - 2.5Ni - 1Mo | X | X | X | ○ | ○ | ○ | ○ |
| 0.005C. - 13Cr - 3Ni - 0.5Mo | X | X | X | ○ | ○ | ○ | ○ |

As is well known, the strength of martensitic stainless steels decreases as the ferrite content of the steel structure increases. When the ferrite content at 1200° C. exceeds 40%, the ferrite content in the normal quenching or normalizing temperature range of 900–1000° C. rises to 20% or more, making it difficult to achieve the high strength required in linepipe tubing and oil-well pipe by tempering at 600° C. or more. Accordingly, to allow tempering to be performed at the temperatures of 600° C. or more necessary to impart good resistance to stress-corrosion cracking, and at the same time satisfy the high-strength requirements for use in pipeline tubing and oil-well pipe, martensitic stainless steels must be composed of not more than 40% ferrite at 1200° C.

Compositions in which the austenite phase (which becomes martensite at room temperature) exists in combination with a ferrite phase comprising 20–30% of the composition have the worst hot workability. When the amount of ferrite is about 40%, the hot workability is about the same as that of austenitic single-phase steels (which become martensitic single-phase steels at room temperature or below the Ms point). The hot workability rises sharply with increasing ferrite content above this point. Thus, because martensitic stainless steels with a ferrite content of 40% or less at 1200° C. have inferior hot workability, their use in the production of high-strength seamless steel pipe by the processes described below tends to result in defects, complicating pipe manufacture.

Seamless stainless steel pipe is generally produced either by an inclined rolling method such as the plug mill or mandrel mill process, or by a hot extrusion method, of which the Ugine-Sejournet and Erhart pushbench processes are typical. However, certain types of martensitic stainless steels (namely, those with a ferrite content of 40% or less at 1200° C.), have poor hot workability. When seamless steel pipe is manufactured from these steels by a cross rolling process such as the plug mill process or the mandrel mill process, defects arise on both the outside and inside walls of the pipe during piercing of the billet on a piercing mill. For this reason, seamless pipe made of this type of steel is generally produced by a hot extrusion process, such as the Ugine-Sejournet process.

However, when a hot extrusion process is employed and the billet directly pierced (a process known as direct piercing), a billet length 5–7 times the diameter results in a greater eccentricity in the wall thickness of the pipe. This makes it difficult to produce long pipe. A partial solution to this problem is provided by a process for producing long pipe that makes use of what is known as the expansion method. This method consists of mechanically opening a guide hole in the center of the billet, then extending the hole. However, even with the use of this expansion method the billet length is still limited to only about 15 billet diameters. Another problem concerns the glass lubricant used in the Ugine-Sejournet hot extrusion process. This must be peeled off following rolling, a process that is both time-consuming and costly.

The limits on billet length inherent in the Ugine-Sejournet and other hot extrusion processes make it impossible to raise productivity above a certain level. Moreover, the use of short billets inevitably results in a low yield and is therefore also disadvantageous in terms of cost. In contrast, both the plug mill and mandrel mill processes involve piercing the billet on a piercing mill that utilizes the Mannesmann effect. These processes permit the manufacture of longer pipe than is possible by the Ugine-Sejournet and other hot extrusion processes. These processes are thus known to be advantageous in terms of productivity and cost. However, as indicated above, certain types of martensitic stainless steels are not suitable for use in the production of seamless pipe on account of the formation of defects during pipe manufacture.

The present invention was arrived at following careful consideration of the problems described above. The object of this invention is to enable the practical application of the plug mill and mandrel mill processes in martensitic stainless steels, particularly those having a ferrite content of 40% or less at 1200° C., for which the manufacture of seamless steel pipe by the plug mill and mandrel mill processes has hitherto been complicated by the formation of defects during pipe fabrication, and by making it possible to use these processes, to enable the manufacture of seamless steel pipe from this type of martensitic stainless steel at high productivity and low cost.

To recapitulate, it has hitherto been possible to manufacture seamless steel pipe made of martensitic stainless steel by the plug mill process or the mandrel mill process without the formation of defects during fabrication when the ferrite content is greater than 40% at 1200° C. However, when steels having a ferrite content of 40% or less at 1200° C. are used, numerous defects arise on the inside and outside walls of the pipe during manufacture, and cracking at the ends of the pipe is also common. This has made it difficult to use these processes in the production of seamless steel pipe. After carefully investigating the causes of such defects in steels with a ferrite content of 40% or less, we discovered that impurities such as P and S in the steel exert a large influence on the formation of these defects. Further examination revealed that by holding the level of S to 0.003% or less and the level of P to 0.020 or less, seamless steel pipe can be produced on a practical basis by both the plug mill process and the mandrel mill process. This discovery led ultimately to the present invention.

SUMMARY OF THE INVENTION

The invention contemplates martensitic stainless steels for use in seamless steel pipe containing not more than 0.30% by weight of C, not more than 1.0% by weight of Si, not more than 2.0% by weight of Mn, 11–14% by weight of Cr, 0.005–0.10% by weight of Al, and not more than 0.10% by weight of N, the remainder being Fe and unavoidable impurities, of which the impurities P and S are held respectively to levels of not more than 0.02% and 0.003% by weight, the ferrite content of these steels being no more than 40% by weight at 1200° C.

This invention also contemplates martensitic stainless steels for use in seamless steel pipe having the contents of C, Si, Mn, Cr, Al, and N noted above, and containing one or more elements selected from the group consisting of up to 3.5% by weight of Ni, up to 2% by weight of Cu, up to 2.5% by weight of Mo, up to 0.10% by weight of Nb, and up to 0.20% by weight of V, the remainder being Fe and unavoidable impurities, of which the impurities P and S are held at the levels cited above, the ferrite content of these steels being no more than 40% by weight at 1200° C.

The present invention furthermore contemplates martensitic stainless steels for use in seamless steel pipe having the above-stated levels of C, Si, Mn, Cr, Al, and N, and containing one or more elements selected from the group consisting of the rare earth elements, Ca, and B, the amount of the rare earth elements ranging from 4×(% of S) to 20×(% of S), that of Ca from 1×(% of S) to 10×(% of S), and that of B from 0.001 to 0.008% by weight, the remainder being Fe and unavoidable impurities, of which the impurities P and S are held at the levels cited above, the ferrite content of these steels being no more than 40% by weight at 1200° C.

Lastly, the invention also contemplates martensitic stainless steels for use in seamless steel pipe having the above-stated levels of C, Si, Mn, Cr, Al, and N, and also containing one or more elements selected from the group consisting of Ni, Cu, Mo, Nb, and V, as well as one or more elements selected from the group consisting of the rare earth elements, Ca, and B, these all being present in the ranges indicated above, the remainder being Fe and unavoidable impurities, of which the impurities P and S are held at the levels cited above, the ferrite content of these steels being no more than 40% by weight at 1200° C.

DETAILED DESCRIPTION OF THE INVENTION

The martensitic stainless steels of the present invention shall now be described in detail. We shall begin by explaining the reasons for each of the limits placed on the contents of the basic constituents in the steels of the invention.

Carbon is necessary for strength. However, because corrosion resistance declines at a carbon content in excess of 0.30%, the upper limit on carbon content has been set at 0.30%.

Chromium markedly increases corrosion resistance in $CO_2$-containing environments. The addition of at least 11% is intended to prevent pitting and crevice corrosion. However, this element also is ferrite-forming. The addition of more than 14% therefore increases the amount of ferrite, making it difficult to achieve the desired strength under the heat conditions (tempering temperature) necessary to preserve resistance of the steel to stress-corrosion cracking. The range in the chromium content was thus set at 11–14%.

Silicon is effective as a deoxidizer and should preferably be included at a level of at least 0.2%. A content of more than 1.0% reduces toughness, so we set an upper limit of 1.0%.

Manganese acts to strengthen the steel and improve toughness. Therefore a content of not less than 0.5% is desirable. However, no further improvement in strength and toughness can be gained from the addition of more than 2.0%. Hence, the Mn content was set at not more than 2.0%.

Aluminum acts as a deoxidizer, reducing the level of oxygen in the steel by oxygen fixation, enhancing the hot workability. The stabilizing effects of Al addition are not observed at less than 0.005%; these effects reach a saturation level at 0.10%. The content of Al was thus limited to a range of from 0.005% to 0.10%.

Nitrogen increases the strength and corrosion resistance of the steel up to a concentration of 0.10%, beyond which additional improvement is not observed. For this reason, the N content was set at not more than 0.10%.

Sulfur is present in the steel as an undesirable impurity that severely reduces the hot workability of the steels in the present invention. This adverse effect is particularly large during piercing of the billet on a piercing mill when the seamless pipe is fabricated by the plug mill process or the mandrel mill process. A sulfur level in excess of 0.003% makes it difficult to produce scratch-free seamless pipe, which is why the S content must be held to no more than 0.003%.

P is another impurity unavoidably present in steels. It produces a marked deterioration in the hot workability of the steel at high temperatures of 1200° C. and above. This element causes scratch formation on the inside wall of the tube during piercing of the billet on a piercing mill. Piercing without scratch formation is difficult at a P level above 0.02%, and so this must be held to 0.02% or less.

In addition to the above basic constituents, the martensitic stainless steels of the present invention may also contain one or more elements selected from the group consisting of Ni, Cu, Mo, Nb, and V, and one or more elements chosen from the group consisting of rare earth metals, Ca, and B. The reasons for the limits set to the contents for each of these are given below.

Nickel: Ni increases corrosion resistance. The addition of more than 3.5%, however, produces no further improvement in corrosion resistance. Because Ni is expensive, the upper limit of addition was set at 3.5%.

Molybdenum: Mo enhances the strength and corrosion resistance of the steel. At levels of under 0.01%, this effect is not fully exhibited, while the addition of more than 2.5% produces no corresponding increase in effect. Because Mo too is a high-priced metal, Mo addition was limited to a range of from 0.01% to 2.5%.

Niobium: Nb increases steel strength, but is ineffective at levels of under 0.01%. The addition of over 0.10% fails to produce additional improvement. The range of Nb addition was thus set at 0.01–0.10%.

Vanadium: V increases the strength of the steel, but is not effective at levels below 0.01%. Further improvement does not result from the addition of more than 0.2%. The range in the content of V was thus set at 0.01–0.2%.

Copper: Copper improves the strength and corrosion resistance of the steel. However, because the addition of more than 2.0% reduces hot workability, the upper limit on copper addition was set at 2.0%.

Rare earth metals (REM), calcium: The rare earth metals and calcium are powerful sulfide-forming elements. The formation of the sulfides of rare earth metals or calcium reduces the amount of sulfur in solid solution within the steel, thereby improving the hot workability of the steel. However when the amount of rare earth elements is four times as great as the sulfur content (wt %) or the amount of calcium less than equivalent to the amount of sulfur, this effect is minor. On the other hand, when the level of rare earth elements is greater than 20 times, or the level of calcium greater than 10 times, the amount of sulfur, this effect reaches a saturation point and the oxides and sulfides of these elements may even have the opposite effect of increasing surface defects. For these reasons, we limited the amount of rare earth metals to a range of from 4×(% S) to 20×(% S), and the amount of calcium to a range of from 1×(% S) to 10×(% S).

Boron: The addition of a trace amount of boron improves the hot workability of the steel. This effect does not arise at a level of less than 0.001%. However, the addition of more than 0.008% of boron has the opposite effect of reducing the hot workability at temperatures of 1200° C. and over. We therefore limited boron addition to a range of 0.001–0.008%.

We have also set a ferrite content for the steels of the present invention of 40% or less at 1200° C. This is because, as we have seen above, even the plug mill and mandrel mill processes can be used to manufacture seamless pipe without hindrance or defects from steels having a ferrite content of more than 40% at 1200° C. The ferrite content (%) at 1200° C. is defined by Eq. (1) below:

$$\text{Ferrite content (\%)} = -195\times(\%\,C) - 185\times(\%\,N) - 18(\%\,Ni) - 6\times(\%\,Cu) - 5\times(\%\,Mn) + 5\times(\%\,Si) + 12\times(\%\,Cr) + 16\times(\%\,V) + 5\times(\%\,Mo) + 6\times(\%\,Nb) + 5\times(\%\,Ti) + 50\times(\%\,Al) - 120 \quad (1)$$

We shall now describe a method for fabricating seamless steel pipe using the martensitic stainless steels of the present invention.

First, a bloom obtained by continuous casting or blooming is rolled into a round billet. This billet is then heated to a given temperature, preferably from 1200 to 1250° C., and pierced and rolled by means of the Mannesmann plug mill process or the Mannesmann mandrel mill process. When the Mannesmann plug mill process is employed, the billet is first pierced on a piercer, then rolled by an elongator, a plug mill, a reeler and a sizer, in that order. When the Mannesmann mandrel mill process is used, the billet is first pierced on a piercer, then rolled respectively on a mandrel mill and hot-stretch reducer. Following this, the pipe is heat-treated either in a batch-type furnace or by induction heating. This heat treatment may consist of quench-tempering, normalize-tempering, or simply tempering. This gives steel pipe of the desired strength. In the case of oil-well pipe, it is more common to first increase the wall thickness at the tube ends by upsetting, then heat-treat.

Table 2 shows the chemical constituents and whether or not defects were formed for a number of examples illustrating the present invention and several comparative examples. In each case, a billet having a diameter of 175 mm was heated to 1230° C. and pierced on a piercer to form a tube with an outside diameter of 185 mm and a wall thickness of 19.76 mm. The inside and outside walls of the tube were examined. An "X" in the table denotes that defects such as scratches or cracks were found on the tube wall. An open circle ○ indicates that no defects were observed, or only minor faults of no practical consequence noted. Theferrite (%) shown in Table 1 shows the ferrite contents(%) at 1200° which were calculated using Eq. (1). If the computed value was negative, this was indicated in the table as 0. The rare earth metals used in the examples shown in Table 2 consisted primarily of cesium (approx. 50%).

The P and S levels of specimens 21–26 (comparative examples) in Table 2 all exceed the upper limits of the ranges set in the present invention. Defects were observed in each of these specimens. Similarly, the levels of the rare earth metals, B, and Ca in specimens 27–29 (comparative examples) all exceeded the upper limits defined above. Defects were again noted in each of these.

As we have indicated in the preceding explanation, the martensitic stainless steels for use in seamless steel tube of the present invention raises the hot workability, and especially the hot piercability, of steels having ferrite contents of 40% or less at 1200° C., despite the difficulty previously encountered in manufacturing seamless pipe from such steels by a plug mill or a mandrel mill process. This is achieved by holding down the P and the S contents of the steel. As a result, seamless steel pipe need no longer be manufactured by a hot extrusion process, and can now be manufactured free of defects by a plug mill or a mandrel mill process. Because this permits the use of plug mill and mandrel mill processes in the production of seamless pipe from this type of steel, higher productivity can be achieved, along with increased yield and reduced costs.

This invention also provides martensitic stainless steels for use in seamless steel pipe wherein, in addition to restricting the levels of P and S, one or more elements selected from the rare earth metals, calcium, and boron are added, further increasing the hot piercability of the steel. This permits the manufacture of defect-free seamless steel pipe by means of a mandrel mill or plug mill process.

TABLE 2

| Specimen No. | Chemical Constituents (Wt %) | | | | | | | | | | | | | | | | | |
|---|---|---|---|---|---|---|---|---|---|---|---|---|---|---|---|---|---|---|
| | C | Si | Mn | P | S | Ni | Cr | Mo | Cu | Nb | V | Al | N | REM* | Ca | B | Ferrite (%) | Defects |
| 1 | 0.20 | 0.51 | 0.52 | 0.016 | 0.001 | — | 13.8 | — | — | — | — | 0.01 | 0.021 | — | — | — | 0 | ○ |
| 2 | 0.15 | 0.55 | 0.62 | 0.014 | 0.002 | — | 13.5 | — | — | — | — | 0.01 | 0.025 | — | — | — | 8.3 | ○ |
| 3 | 0.19 | 0.43 | 0.63 | 0.008 | 0.002 | — | 13.1 | — | — | — | — | 0.015 | 0.024 | — | — | — | 0 | ○ |
| 4 | 0.15 | 0.55 | 0.78 | 0.018 | 0.001 | — | 13.1 | — | — | 0.05 | — | 0.01 | 0.027 | — | — | — | 2.3 | ○ |
| 5 | 0.14 | 0.25 | 0.67 | 0.013 | 0.002 | — | 11.8 | — | — | — | 0.12 | 0.02 | 0.025 | — | — | — | 0 | ○ |
| 6 | 0.15 | 0.38 | 0.53 | 0.015 | 0.001 | — | 13.3 | — | — | — | — | 0.02 | 0.026 | — | — | — | 9.9 | ○ |
| 7 | 0.14 | 0.45 | 0.70 | 0.018 | 0.002 | — | 12.8 | — | — | — | — | 0.02 | 0.027 | 0.021 | — | — | 1.0 | ○ |
| 8 | 0.15 | 0.43 | 0.56 | 0.011 | 0.001 | 0.5 | 12.7 | — | — | — | — | 0.01 | 0.024 | — | — | — | 0 | ○ |
| 9 | 0.13 | 0.45 | 0.52 | 0.014 | 0.002 | — | 12.2 | — | — | 0.05 | 0.10 | 0.02 | 0.023 | — | — | — | 0 | ○ |
| 10 | 0.14 | 0.25 | 0.54 | 0.010 | 0.001 | — | 13.1 | 1.0 | — | — | 0.2 | 0.01 | 0.021 | — | 0.005 | — | 13.3 | ○ |
| 11 | 0.14 | 0.27 | 0.75 | 0.016 | 0.002 | — | 13.1 | 2.0 | — | — | — | 0.01 | 0.020 | — | — | 0.005 | 14.3 | ○ |
| 12 | 0.10 | 0.75 | 0.77 | 0.011 | 0.003 | — | 13.1 | 2.2 | 0.5 | — | 0.1 | 0.01 | 0.032 | — | — | — | 30.3 | ○ |
| 13 | 0.10 | 0.30 | 0.54 | 0.019 | 0.001 | 1.5 | 13.2 | 0.4 | — | 0.02 | 0.05 | 0.04 | 0.021 | — | — | — | 0 | ○ |
| 14 | 0.03 | 0.52 | 0.61 | 0.015 | 0.001 | 3.1 | 13.3 | 0.5 | — | — | — | 0.02 | 0.022 | — | — | — | 0 | ○ |
| 15 | 0.03 | 0.36 | 0.68 | 0.018 | 0.002 | 2.5 | 13.2 | 0.6 | — | — | — | 0.02 | 0.052 | — | — | — | 0 | ○ |
| 16 | 0.03 | 0.26 | 0.70 | 0.016 | 0.002 | 2.4 | 13.1 | 1.0 | 0.7 | — | — | 0.01 | 0.076 | 0.011 | — | — | 0 | ○ |
| 17 | 0.20 | 0.35 | 0.63 | 0.019 | 0.003 | 0.2 | 13.2 | — | 0.15 | — | — | 0.02 | 0.030 | — | 0.003 | 0.002 | 0 | ○ |
| 18 | 0.19 | 0.36 | 0.70 | 0.019 | 0.003 | 0.2 | 13.1 | — | 0.10 | 0.05 | — | 0.03 | 0.025 | 0.015 | 0.003 | 0.002 | 0 | ○ |
| 19 | 0.19 | 0.38 | 0.69 | 0.018 | 0.003 | 0.10 | 13.3 | 0.5 | 0.12 | 0.03 | — | 0.02 | 0.021 | 0.016 | 0.003 | — | 0 | ○ |
| 20 | 0.005 | 0.41 | 0.90 | 0.018 | 0.003 | 3.4 | 12.8 | 0.3 | 0.10 | — | — | 0.02 | 0.010 | 0.022 | — | 0.002 | 0 | ○ |
| 21 | 0.20 | 0.54 | 0.51 | 0.025 | 0.005 | — | 13.1 | — | — | — | — | 0.01 | 0.025 | — | — | — | 0 | x |
| 22 | 0.18 | 0.52 | 0.52 | 0.032 | 0.006 | — | 13.2 | — | — | — | — | 0.01 | 0.021 | — | — | — | 0 | x |
| 23 | 0.19 | 0.40 | 0.48 | 0.022 | 0.010 | — | 13.1 | — | — | — | — | 0.01 | 0.024 | — | — | — | 0 | x |
| 24 | 0.15 | 0.25 | 0.72 | 0.025 | 0.005 | — | 12.2 | 0.4 | — | 0.03 | — | 0.02 | 0.023 | — | — | — | 0 | x |
| 25 | 0.14 | 0.38 | 0.46 | 0.028 | 0.004 | — | 13.2 | — | — | — | 0.08 | 0.01 | 0.028 | — | — | — | 7.8 | x |
| 26 | 0.05 | 0.39 | 0.68 | 0.022 | 0.008 | 2.8 | 13.2 | 0.7 | 0.2 | — | — | 0.02 | 0.030 | — | — | — | 0 | x |
| 27 | 0.03 | 0.26 | 0.61 | 0.018 | 0.003 | 2.5 | 13.1 | 0.5 | — | 0.02 | — | 0.04 | 0.031 | 0.10 | — | — | 0 | x |
| 28 | 0.05 | 0.35 | 0.58 | 0.019 | 0.002 | 1.0 | 13.1 | 0.2 | — | — | — | 0.01 | 0.025 | — | — | 0.020 | 0 | x |
| 29 | 0.03 | 0.41 | 0.77 | 0.018 | 0.002 | 2.5 | 12.9 | 0.5 | — | — | — | 0.01 | 0.031 | — | 0.05 | — | 0 | x |

*Rare earth metals

We claim:

1. Martensitic stainless steel for manufacture of seamless steel pipe by the Mannesmann plug mill process, said steel consisting essentially of 0.03 to 0.30% by weight of C, not more than 1.0% by weight of Si, not more than 2.0% by weight of Mn, 11.8–14% by weight of Cr, 0.005–0.10% by weight of Al, and not more than 0.10% by weight of N, and containing also one or more elements selected from the group consisting of up to 3.5% by weight of Ni, up to 2% by weight of Cu, up to 2.5% by weight of Mo, up to 0.10% by weight of Nb, and up to 0.2% by weight of V, wherein the amount of P is held to no more than 0.02% by weight and the amount of S to no more than 0.003% by weight, the remainder being substantially Fe, said steel having a ferrite content of not more than 40% by weight at 1200° C.

2. Martensitic stainless steel for manufacture of seamless steel pipe by the Mannesmann plug mill process, said steel consisting essentially of 0.03 to 0.30% by weight of C, not more than 1.0% by weight of Si, not more than 2.0% by weight of Mn, 11.8–14% by weight of Cr, 0.005–0.10% by weight of Al, and not more than 0.10% by weight of N, and containing one or more elements selected from the group consisting of up to 3.5% by weight of Ni, up to 2% by weight of Cu, up to 2.5% by weight of Mo, up to 0.10% by weight of Nb, and up to 0.2% by weight of V, as well as one or more elements selected from the group consisting of the rare earth elements, Ca, and B, the amount of the rare earth elements ranging from 4×(% of S) to 20×(% of S), that of Ca from 1×(% of S) to 10×(% of S), and that of B from 0.001 to 0.008% by weight, wherein the amount of P is held to no more than 0.02% by weight and the amount of S to no more than 0.003% by weight, the remainder being substantially Fe, said steel having a ferrite content of not more than 40% at 1200° C.

3. The Martensitic steel of claim 1 wherein the amount of S is not more than 0.002% by weight.

4. The Martensitic steel of claim 3 wherein the amount of S is not more than 0.002% by weight.

* * * * *